United States Patent [19]

Booth

[11] 4,040,065

[45] Aug. 2, 1977

[54] PHOTOCOMPOSER OPTICAL SYSTEM WITH A NEGATIVE COLLIMATING LENS

[75] Inventor: Thomas Allan Booth, Flanders, N.J.

[73] Assignee: Addressograph Multigraph Corporation, Cleveland, Ohio

[21] Appl. No.: 649,073

[22] Filed: Jan. 14, 1976

[51] Int. Cl.[2] ..... B41B 15/08

[52] U.S. Cl. ..... 354/5; 354/15

[58] Field of Search ..... 354/5, 7, 10, 12, 13, 354/14, 15, 16; 350/184, 187

[56] References Cited

U.S. PATENT DOCUMENTS

| | | | |
|---|---|---|---|
| 2,670,665 | 3/1954 | Caldwell | 354/13 |
| 3,909,832 | 9/1975 | Booth | 354/5 |
| 3,914,774 | 10/1975 | Griffith | 354/5 |

*Primary Examiner*—L. T. Hix
*Assistant Examiner*—Alan Mathews
*Attorney, Agent, or Firm*—Ray S. Pyle

[57] ABSTRACT

In a photocomposer, a collimated optical system to enable a decollimator and reflective surface to space characters along a composition line, with a variable size determining primary lens and a negative collimating lens, whereby the optical path is greatly foreshortened.

3 Claims, 4 Drawing Figures

PHOTOCOMPOSER OPTICAL SYSTEM WITH A NEGATIVE COLLIMATING LENS

BACKGROUND OF THE INVENTION

An example of a collimated beam optical system for photographic composing apparatus is taught by S. H. Caldwell U.S. Pat. No. 2,670,665. This device employs a fixed position collimating lens, and a decollimating lens with an angular mirror carried by a carriage. The carriage moves through a composition text line by a stepping drive system. Because a collimated beam is of indefinite length, it may be intercepted by a decollimator at any position. Therefore, an oscillating carriage with a decollimator, with an angular deflector, can be used to step a line of characters along a photosensitive sheet for text composition.

An application Ser. No. 585,610 by Francis S. Szabo is pending before the Patent Office and teaches the use of a variable position lens to produce an aerial image of desired size which is then projected through a collimator lens and decollimated as taught by the prior art. This later copending development concept requires considerably more optical path space than the original shown in U.S. Pat. No. 2,670,665, but provides a very desirable point size change capability.

SUMMARY OF THE INVENTION

It is the intent and principal object of this invention to foreshorten the space requirements for the collimated optics of a variable point size photocomposition machine.

DESCRIPTION OF THE PREFERRED EMBODIMENT

Figure 1:
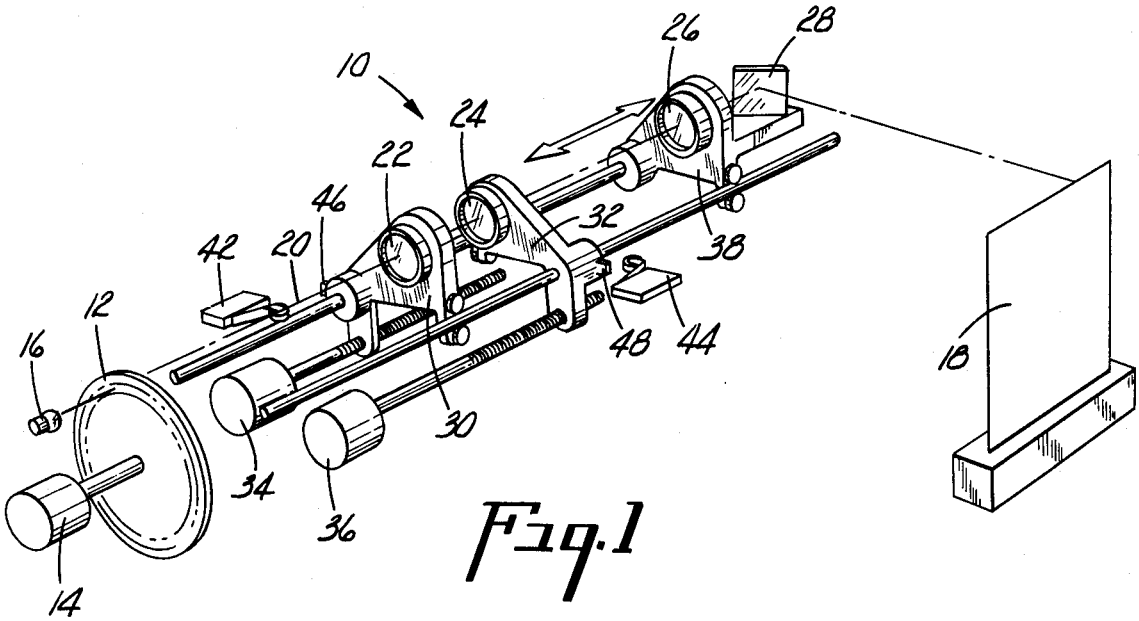
FIG. 1 is a simplified perspective view of the lens system associated with the present invention.

Referring now, more particularly, to FIG. 1 of the drawings, the optical system associated with the present invention is generally indicated by the numeral 10 and includes a character storage disc 12 which is rotated by a drive motor 14. Preferably the disc is of a conventional type and contains various alphanumeric characters which are defined by transparent areas, not illustrated. A conventional flash lamp 16 or other appropriate light source projects a selected character image through the lens system onto a photosensitive film or tape indicated by the numeral 18. Each time flash lamp 16 is energized, a character image is projected along a path generally indicated by the numeral 20. The image is received by variator lens 22 and projected into collimator lens 24. The light column from the collimating lens is parallel and does not come to a focus. Focusing is achieved by decollimating lens 26.

Variator and collimator lenses 22 and 24 are mounted to carriages 30 and 32, respectively, which are controlled by stepper motors 34 and 36, or other appropriate drive means. Decollimator lens 26 and mirror 28 are mounted to a third carriage 38, which is controlled by a stepper motor 40. (Now shown.) carriage 38 is moved laterally of the photosensitive member 18, whereby the selective characters are spaced across the photosensitive member to provide a composed line of type. Since the distance between the decollimator lens 26 and photosensitive member 18 remains constant, the movement of carriage 38 does not affect focusing of the image.

Focusing as well as magnification is controlled by the respective positions of the variator and collimator lenses 22 and 24. Position command signals are provided to stepper motors 34 and 36 which move the lenses in position for proper magnification and focusing, as hereinafter described. When utilizing stepper motors, the position command data is provided in terms of motor steps from some reference positions. The reference positions are defined by home position switches 42 and 44 or other sensing means associated with the variator and collimator lenses, respectively. These may be conventional microswitches having actuators positioned for engagement by tab members associated with the lenses, such as those indicated at 46 and 48.

The structure thus far described is of a photocomposition machine having collimating and decollimating lens system wherein the decollimating lens is driven in a composition path through escapement steps. An aerial image is provided to the collimating lens by a primary lens positioned to project an illuminated character to an aerial image. The primary lens will provide an aerial image of preselected size, and means is provided for adjusting the primary lens and collimating lens to focus the aerial image at the focal plane of the collimating lens.

The primary lens may be a fixed focus variator lens movable to produce an aerial image, or a "zoom" lens which has a fixed system position with movable interior parts. Hence the invention may be said to employ a lens means for producing an aerial image of selected size. A variator lens is a term of art which connotes a variable position focusing lens. In this description, the primary lens is a variator lens.

According to this invention, that prior construction is folded into a much smaller optical area by the provision of collimator lens 24 as a negative lens positioned in optical alignment with the primary lens to allow the converging beam of the primary lens to pass through the negative lens with the lenses positioned apart a distance equal to the difference between the image conjugate length of the primary lens and the absolute focal length of the collimator lens, such that the rays of the primary lens are collimated.

Because the reduction of the space requirements over prior machines is so drastic, and the solution taught herein so deceptively simple, it is desirable that the relationship be further explained. In the optical system which uses a positive collimator, an aerial image is formed by the variator lens. This image is located on the opposite side of the variator away from the source. The positive collimator is located a distance beyond the aerial image equal to its own focal length. Thus, the length of the optical system would include the total image-object distance of the variator system plus the focal length of the collimator lens. Furthermore, the rays from the edge of the aerial image are diverging outwardly. The further away the collimator is, the wider it must be to collect these rays.

By the use of the negative lens collimator as shown in the drawing, the negative lens is placed with its focal length toward the primary lens from the aerial image. This results in the primary and negative collimator lenses being positioned apart a distance equal to the difference between the image conjugate length of the primary lens and the absolute focal length of the collimator lens. This arrangement shortens the length of the optical system by a length equal to twice the collimator focal length. Also, very important to understand, is that because the negative collimator lens is close to the primary lens, the divergence will be minimized and therefore a much less expensive collimator lens is required.

Although previously disclosed in copending application Ser. No. 585,610 assigned to the assignee of this present invention, it is believed desirable for the purpose of making a complete disclosure, to set forth the preferred means for changing the relationship of the variator and negative collimator lens in order to permit the changing of point size at any time, even within a line of composition, and to the extreme extent of changing the size of only one letter in a line of composition. The balance of this specification will therefore be directed to the means for providing a program control for the use of the described apparatus.

Figure 2:
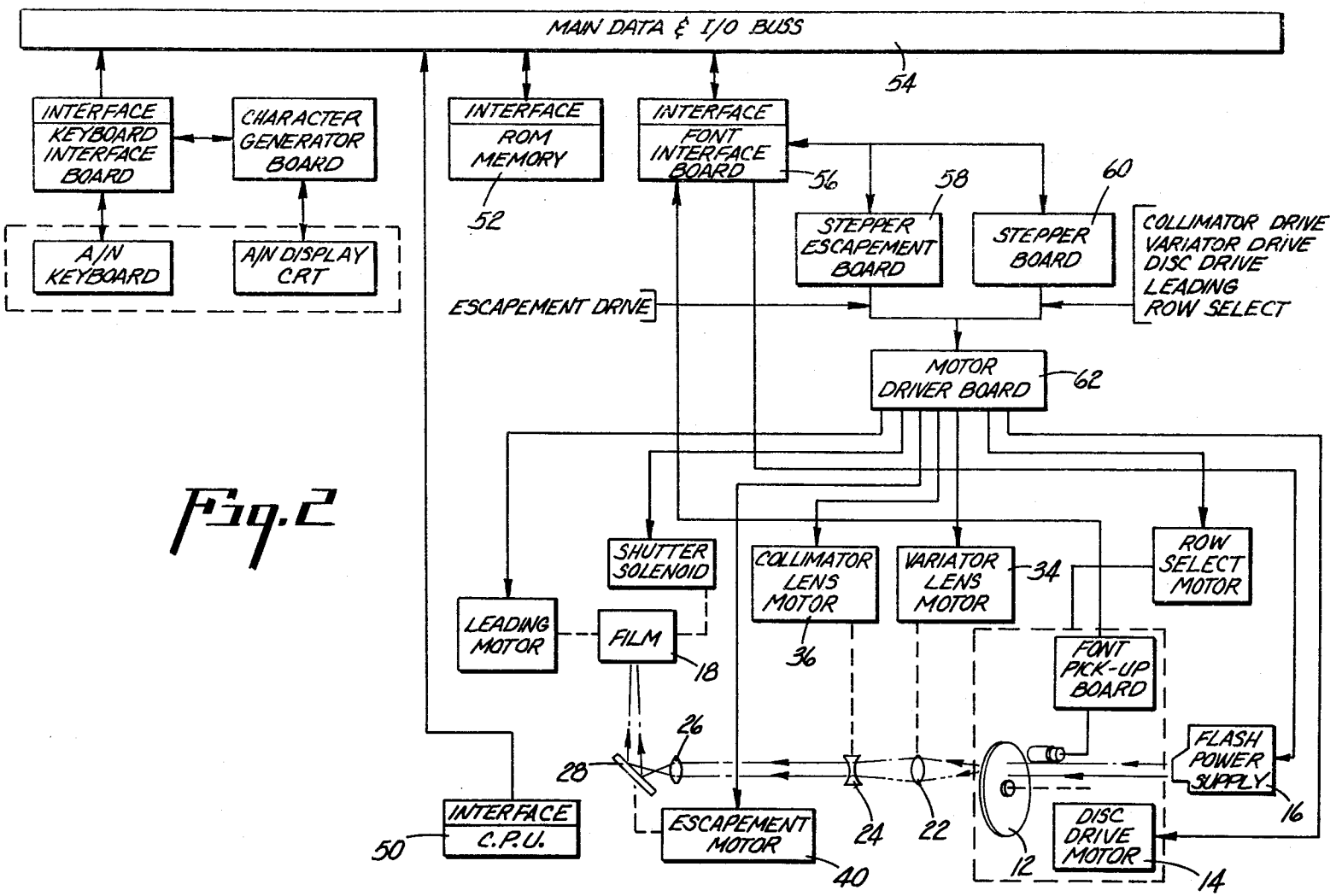
FIG. 2 is a block diagram of a typical control system associated with the present invention.

Referring to FIG. 2, appropriate means for controlling the lens positions is illustrated in simplified block diagram form. This system is described in detail in the copending patent application Ser. No. 523,558 to be allowed per Examiner's Communication, Paper No. 12, dated Apr. 18, 1977 and Ser. No. 585,610. Control of the system is provided by an appropriately programmed central processing unit (CPU) 50 and read only memory (ROM) 52 containing an application program. The CPU may be a commercially available microprocessor, such as the Intel Corporation No. 8008 Microprocessor. The CPU together with ROM 52 provides handling of all input commands and type character key strokes selected by the machine operator. Several other functions are also carried out under control of the processor including the various commands controlling the stepper motors and the flashing of selected characters. These commands are handled through data buss 54 and Font Interface Board 56 to a Stepper Escapement Board 58 and Stepper Board 52. The Stepper Escapement Board contains the logic to control carriage 38 upon receipt of input command data from the CPU. Control logic registers and controls for the collimator and variator stepper motors are contained on Stepper Board 60. Position control signals from the Stepper Board and Stepper Escapement Board are provided to a Motor Driver Board 62 which converts the signals to higher voltage and current values for proper operation. The control signals provided through Boards 60 and 62 may be described as position command data which is representative of the number of steps which a motor is to be driven. With the type of control system illustrated in FIG. 2, the variator and collimator lenses ae moved by position command data which is a function of the selected character image size and determined system parameters.

As mentioned above, the conventional methods for setting up photocomposition machines, of this type are complex, time-consuming and costly. This is due primarily to variances in lens parameters, such as focal length, and mechanical variances inherent within the lens mounting and associated mechanism. Setup procedures for such machines also required that the home position switches or other sensors be mounted at precise trip locations in order to assure proper focusing and magnification. This procedure was time-consuming in itself since the position of each switch housing was not necessarily the same as the trip location, due to variances between the actuator and switch contacts. Mechanical variances are also inherent within the carriage drive mechanism and stepper motors. These often cause inaccurate positioning of the lenses resulting in poor focusing and improper magnification.

The method and apparatus set forth herein provide a relatively simple technique for utilizing a given set of lenses with a given photocomposition machine since such compensates for variances in both lenses and machine parameters. The method and apparatus may be more fully understood by referring to FIG. 3 of the drawing. The variator lens serves as prime magnification control. As this lens is moved to various longitudinal positions relative to a fixed object (Disc 12), aerial images of commensurate magnification occur at respective image locations. The distance from the object to the variator lens nodal is indicated by the dimension "$V_p + X$".

The position of the first aerial image with respect to the object may be defined by the Gaussian equation:

$$I = \frac{F(M_v + 1)^2}{M_v} \tag{1}$$

where $M_v$ = Variator magnification at desired image size, and

F = Focal length of the variator.

The position of the variator lens as a function of magnification may be defined by the equation:

$$V_p + X = \frac{F(M_v + 1)}{M_v} \tag{2}$$

where $X$ = The distance of the variator home switch from the object, and $V_p$ = Distance of the variator from its home position switch.

It follows from Equation (2) that the variator position may be expressed as:

$$V_p = \frac{F(M_v + 1)}{M_v} - X \tag{3}$$

It will be appreciated that the collimator/decollimator lens combination has the additional function of providing a fixed magnification base for the entire lens system. Numerically, this is the ratio of the decollimator focal length to the collimator focal length. The magnification of the overall system is the product of the variator magnification ($M_v$) and collimator/decollimator magnification, which is denoted as $M_c$. The variator magnification at a desired point size may be expressed as:

$$M_v = \frac{P}{(M_c)(S_m)} \tag{4}$$

where $P$ = Selected image point size, and $S_m$ = Object character size on storage disc.

In order to achieve the desired magnification, as well as maintain suitable focus quality, it is necessary to locate the variator and collimator lense in precise longitudinal positions relative to the object. As the variator lens is moved longitudinally, the first aerial image is shifted longitudinally along the optical path. In order to achieve proper focusing, it is necessary tht collimator lens be positioned from the first aerial image a distance equal to its focal length. The position of the collimator lens is referenced to its home position switch and may be expressed in terms of motor steps from the home switch. For the purposes of the control system, the collimator position is expressed by the following equation:

$$C_p = C_o - F\left[\frac{(M_v + 1)^2}{M_v} - 4\right] \tag{5}$$

where $C_o$ = Collimator steps from the home switch at 1:1 magnification of variator.

Equations (3), (4) and (5) are the basic focus algorithms for the lens system. The CPU is provided with an approprite program which makes in-process calculation of $M_v$, $V_p$ and $C_p$ for each selected image point size. The values for F, X, $M_c$ and $C_o$, which may be referred to as system parameters, are determined empirically with the lenses mounted in the machine. It will be appreciated that these parameters take into consideration variances in lens parameters, such as focal length, and mechanical variances within the lens control mechanism including the home position switches. Once these paameters have been determined empirically, they are stored in a memory associated with the CPU and are used by the on-line program to compute the positions of the lenses as a function of selected character image size.

Figure 3:
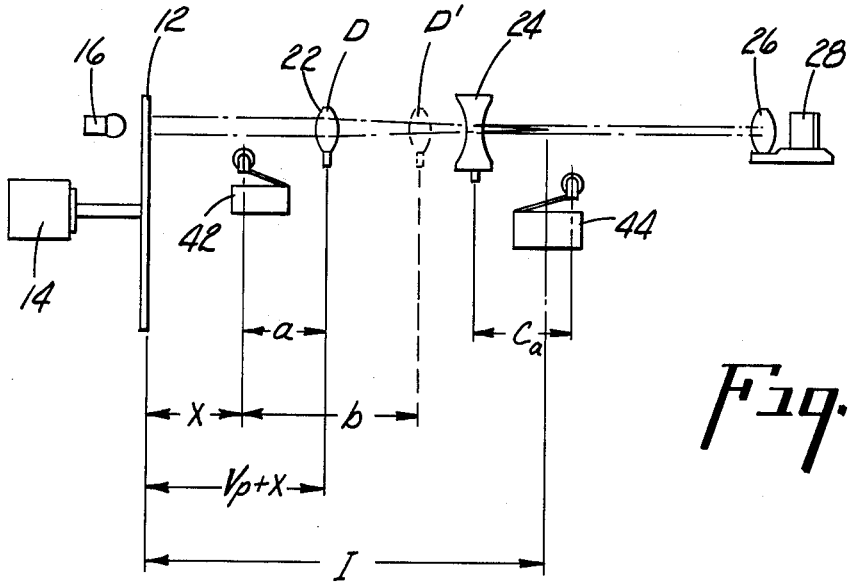
FIG. 3 is a schematic diagram of the lens system illustrating various measurements associated with the method of the present invention.

The preferred embodiment of the method of the present invention which is used to determine the values for the system parameters entails measurements at two variator positions while maintaining the collimator at a fixed location. The lenses are mounted in the machine and the collimator lens is moved from its home switch a predetermined number of steps. This is some optimum location which is known to provide focusing during setup so long as the lens and machine parameters are within acceptable tolerances. As the collimator lens carriage is moved from its home position, the number of motor steps is recorded with the aid of a test program or other appropriate means. With the collimator lens at a position $C_a$, the variator lens is stepped from its home position until a focused image is provided on the photosensitive paper. In the actual setup procedure this is achieved by exposing the photosensitive paper with a series of images, each corresponding to a different variator position. This is done in a variator lens position range known to produce a focused image so long as the lens and machine variances are within expected tolerances. Each image corresponds to a variator lens position which may be expressed in terms of steps (or other command data) from the variator home position switch. The best focused image is selected from the test paper and the corresponding variator lens position is recorded. This indicated by the dimension "a" is shown in FIG. 3. In addition, the size of the focused image is measured on the test paper and is recorded for subsequent calculations.

With the collimator lens held at the same position, the variator lens is moved until a second focus condition is achieved. This is indicated by the dimension "*b*". At this position of the variator lens, the first aerial image is at the same location, thereby providing a focused image on the photosensitive paper. The position of the variator lens in terms of motor steps is recorded and the size of the focused image is measured from the test paper and recorded for subsequent calculations.

Using these five empirical measurements, namely, *a*, *b*, $C_a$, and the two image sizes ($S_a$ and $S_b$), the four system parameters may be calculated. Each of the parameters may be defined algebraically in terms of the empirical measurements or other quantities which may be arrived at as a result of the measurements.

The value of $M_c$, magnification ratio contributed by the collimator/decollimator lens combination, may be calculated from the following equation:

$$M_c = \frac{\sqrt{S_a \times S_b}}{S_m} \tag{6}$$

Equation (6) may be arrived at by the following algebraic computation:

$$M_a = \frac{MA}{M_c} = \frac{1}{M_b} = \frac{1}{MB/M_c} = \frac{M_c}{MB}$$

It follows that:

$$M_c^2 = MA \times MB$$

Where

MA = $S_a/S_m$ = System magnification ratio with variator at "a", $MB = S_b/S_m$ = System magnification ratio with variator at "*b*".

Substituting in the above equation, one arrives at:

$$M_c^2 = \frac{S_a}{S_m} \times \frac{S_b}{S_m}$$

$$M_c = \frac{\sqrt{S_a \times S_b}}{S_m}$$

The variator focal length F may be calculated from the following equation:

$$F = \frac{\sqrt{S_a S_b (b-a)}}{S_b - S_a}$$

This equation may be arrived at by the following algebraic computations:

$$b + X = \frac{F(M_b + 1)}{M_b}$$

$$a + X = \frac{F(M_a + 1)}{M_a}$$

$$a - b = F\left[\frac{(M_a + 1)}{M_a} - \frac{(M_b + 1)}{M_b}\right]$$

-continued $$F = \frac{a - b}{\left[\frac{(M_a + 1)}{M_a} - \frac{(M_b + 1)}{M_b}\right]}$$

$$F = \frac{M_a M_b (a - b)}{M_b - M_a}$$

where $M_a = \frac{\sqrt{S_a S_b}}{S_b}$ $$M_b = \frac{\sqrt{S_a S_b}}{S_a}$$

$$F = \frac{\frac{S_a S_b}{S_a S_b}(a - b)}{\frac{\sqrt{S_a S_b}}{S_a} - \frac{\sqrt{S_a S_b}}{S_b}}$$

$$F = \frac{(a - b)\sqrt{S_a S_b}}{S_b - S_a}$$

The trip position of the variator home switch from the character disc cannot be measured in terms of actual motor steps since the disc is in the path of lens movement. Therefore, it is determined algebraically from the following equation:

$$X - \frac{(b - a)}{(S_a - S_b)}\left[\sqrt{S_a S_b} + S_b\right] - a \quad (8)$$

This expression is arrived at from the basic Gaussian equation:

$$X + a - \frac{F(M_a + 1)}{M_a}$$

and by substituting $$M_a = \sqrt{S_a S_b} / S_b$$

$$M_b = \sqrt{S_a S_b} / S_a$$

System parameter $C_o$, which is the number of collimator steps from the home switch for proper focusing with the variator magnification ratio at 1:1, may be expressed by the equation:

$$C_o = F\left[\frac{(M_a + 1)^2}{M_a} - 4\right] + C_a \quad (9)$$

where $C_a$ = Collimator steps from the home switch with the variator at magnification ratio $M_a$.

The value $C_a$ is actually counted and recorded during the initial setup. The value for $M_a$ may be determined by the equation:

$$M_a = S_a S_b / S_b$$

by inserting the measured image size values.

The above-described procedure is merely exemplary of the setup procedure associated with the present invention. If desired, other empirical measurements may be utilized to calculate the above system parameters. For example, under some circumstances it may be desirable to take measurements with the collimator lens at different positions. The calculations would still take into consideration both lens and machine variances so long as the lens positions are measured in terms of the motor steps or other appropriate position command data.

In the actual machine developed, each step is a very small increment, such that each motor has a range of seven thousand steps. In a typical lens-machine combination the empirically determined parameters, F, $C_o$, $M_c$, and X, will usually be high numerical values. It would require a large random access (RAM) or programmable read only memory (PROM) for storing such values. This would be a significant cost factor in the price of the overall machine.

One of the unique features of the present invention is the provision of a relatively inexpensive means of storing the system parameters without using a large RAM or PROM. It was found that the system parameters vary within certain ranges for various lens-machine combinations. For example, the focal length F of a given variator lens may vary between 975 and 1010 motor steps. This value may be expressed in terms of a variance from some base value such as the average value, or expected low value, for all variator lenses from a group of lenses of known quality. The variance value may be expressed in terms of a plus or minus value. In the preferred embodiment of the present invention, a ROM is provided which contains data representative of the base values for the system parameters. After the actual parameter values have been determined, the variance values are calculated and stored as binary data in a group of manually settable switches commonly called "DIP" switches. With the actual machine developed, the variant data requires a total of 16 bits, with F requiring 5 bits, $C_o$ — 4 bits, $M_c$ — 2 bits, and X — 5 bits.

It will be appreciated that this arrangement is relatively inexpensive compared to the cost of a RAM of sufficient size to accommodate storage of the determined parameter value. Furthermore, it provides an extremely simple means of storing the parameter data in an assembly line procedure without the use of complex programming procedures. The operation of the machine is such that when a point size change is made by the operator, the program combines the variant and base data for each parameter and applies such to the lens position algorithms.

Figure 4:
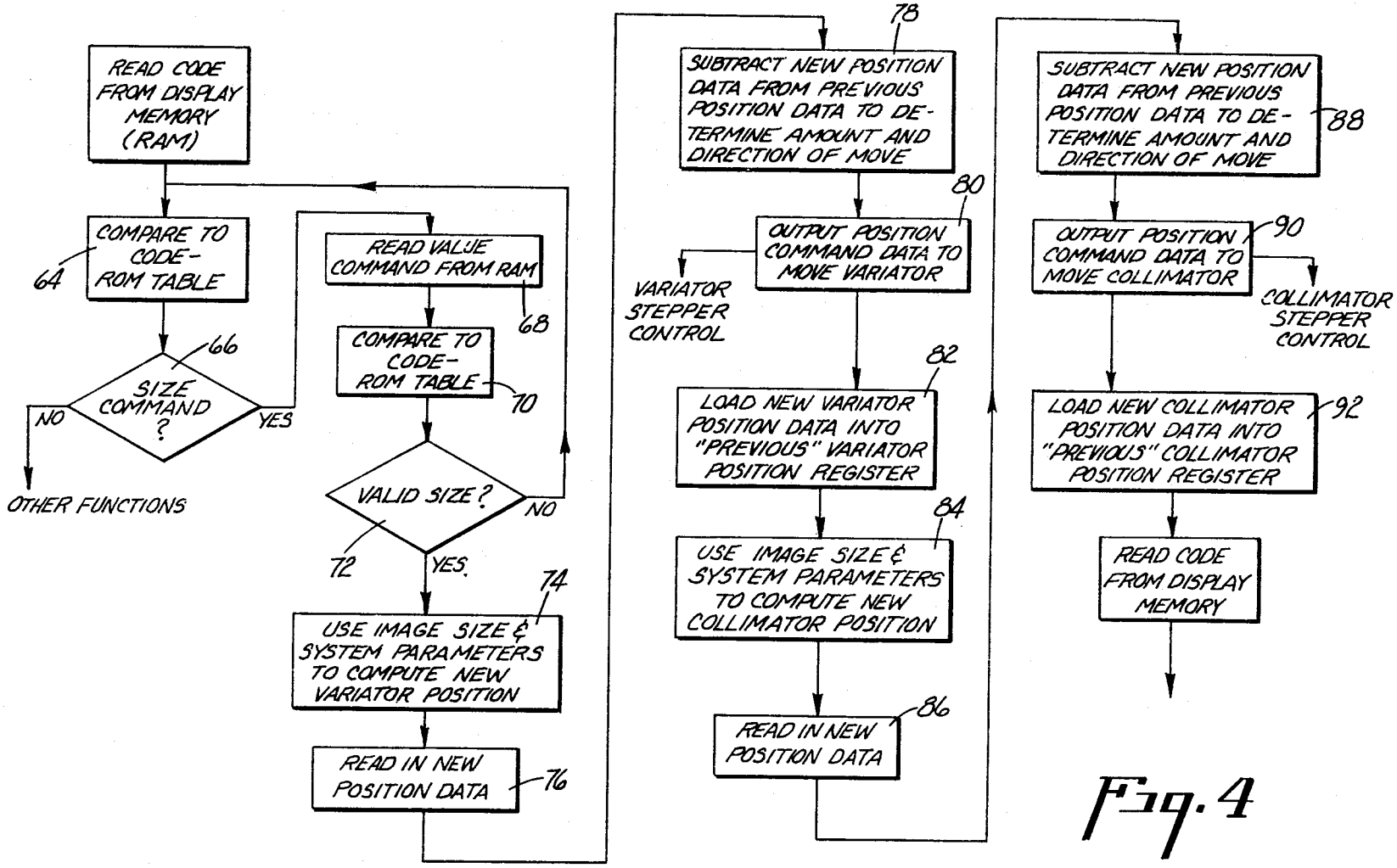
FIG. 4 is a flow chart showing a typical variator/collimator control program routinely associated with the present invention.

As mentioned above, the CPU is provided with an on-line program which calculates by the above algorithms the lens position data as a function of selected point size and the previously stored system parameters. Each time the operator selects a new point size, these calculations are made by the on-line program which results in position command data for moving the lenses to a new position. FIG. 4 is a simplified flow chart of the variator/collimator lens position routine associated with such an on-line program.

The CPU is provided with a look-up table in RAM for converting the keyboard code to CPU code. As the CPU looks at the data stored in the RAM it continuously compares the codes, as indicated diagrammatically by block 64. Upon recognition of a point size command, as indicated by block 66, the program will proceed with the routine. On the other hand, if there is no point size command present in the RAM, the program will perform various other functions.

When a point size command is recognized, the point size value associated with the command is read from the display memory. This operation is indicated by block 68. Since this point size value is in keyboard code, such is converted into CPU code via a ROM look-up table indicated functionally at 70. The program further checks to see if the point size value is "Valid Size", as it is possible that the operator may accidently enter numbers which do not fall within the range of acceptable point size values, in which event, the routine is terminated by a decision indicated by block 72. If the point size value is "Valid", such is applied to the algorithm $V_p = [F(M_v+1)/M_v] - X$ to compute the "New" variator position data. This is indicated by blocks 74 and 76.

The current position of the variator lens is stored in a register, or the like, associated with the CPU. This data is described as the "Previous" select lens position data as it corresponds to the previously desired position. The position data corresponding to the newly desired position is referred to as the "New" position data. The program determines the difference between the "New" and "Previous" position data and the direction in which the variator lens carriage must be moved. This operation is indicated diagrammatically by block 78. The difference data is outputted in the form of position command data as indicated by block 80.

The "Position Command Data" is used by the program to provide signals to the variator stepper control, whereby the variator carriage is stepped in accordance with the above description. The "new" variator position data is loaded into CPU register, as indicated by block 82, to provide the "Previous" position data when the program executes the next routine in response to detection of a new point size command in the display memory.

After providing the output to the variator stepper control, the above routine proceeds in a similar manner to provide position command data for the collimator lens. The point size value is applied to the algorithm $C_P = C_o - F[[(M_v + 1)^2/M_v] - 4]$ to compute the "New" collimator position data, as indicated by blocks 84 and 86. The "Previous" position data for the collimator lens carriage is stored in an appropriate register, or the like, associated with the CPU. The program determines the difference between the "New" position data and the "Previous" position data to provide "Position Command Data" (block 88), which is outputted to the collimator stepper control, as indicated by block 90. The "New" collimator position data is then loaded into the register provided for the "Previous" collimator position as indicated by block 92. The program then refers back to the RAM to repeat the routine or perform other functions in response to commands recognized in the memory.

It will be appreciated that the routine may be modified to provide control of a lens system employing lens other than the variator and collimator lenses disclosed.

From the foregoing description, it will be appreciated that the present invention provides a relatively simple and inexpensive means of utilizing a given set of lenses with a given photocomposition machine. The unique procedure for determining the system parameters requires only five empirical measurements. Furthermore, the determined parameters take into consideration manufacturing variations in both the lenses and the associated control mechanism. The use of "DIP" switches for storage of the variance data associated with the parameter results in a significant cost savings compared with the use of RAM or PROM for parameter storage.

It will be appreciated also that since the system computes each lens position, rather than reading such from a look-up table, an unlimited number of image sizes may be accommodated. Furthermore, the system is not limited to the use of standard point sizes and any image size value may be accommodated so long as it is within a range acceptable to the system. Thus, special applications may be provided for without making changes to the lens position algorithms or associated program routines.

The lens position algorithms and associated programs may also be used for lens systems providing much larger magnification ranges. For example, lenses having different focal lengths may be installed in a machine for special customer applications. This would change the system parameters values, but would not entail modifications to the basic lens position algorithms and associated programs.

It is not intended that the present invention be limited to the use of the specific system parameters described above or the specific method for empirically determining the parameter values. It is foreseeable that other parameters and setup procedures may be utilized which take into consideration both lens and machine variances and it is intended that such be encompassed in the scope of the present invention. It will also be understood that the above description of the present invention is susceptible to other various modifications, changes and adaptations, and the same are intended to be comprehended within the meaning and range of equivalence of the appended claims.

What is claimed is:

1. A photocomposition machine wherein the optical system is foreshortened to reduce the amount of open interior space required for image projection, comprising:

an illuminated font source;

primary focusing lens means for producing a selected variable size aerial image;

a negative collimating lens positioned in optical alignment with said primary focusing lens means to allow the converging beam of the primary lens means to pass through the negative lens with the lenses positioned apart a distance equal to the difference between the image conjugate length of the primary lens and the absolute focal length of the collimator lens such that the rays of the primary lens are collimated; and a decollimating means in optical alignment with said negative lens to refocus the font image projection.

2. The machine of claim 1, wherein a mirror is coupled with said decollimating means, and an escapement carriage on which are mounted said mirror and said decollimating means to enable a stepwise placement of projected characters in sequence.

3. A photocomposition machine wherein the optical system is foreshortened to reduce the amount of open interior space required for image projection, comprising:

an illuminated font source;

a variator lens optically aligned with said font to produce an aerial image of characters of said font;

a flash light for illuminating said font source;

a negative collimating lens positioned in optical alignment with said variator lens to allow a converging beam of the variator lens to pass through the negative lens with the lenses positioned apart a distance equal to the difference between the image conjugate length of the primary lens and the absolute focal length of the collimator lens;

a decollimating lens and mirror mounted on a carriage, and means to shift the carriage through an escapement path while aligned with said collimating lens; and control means for selecting the variator and collimator lenses positions to produce a selected point size, and to illustrate a character of said font at a time and positioned to project the character through sid optical system.

* * * * *